US011530081B2

(12) United States Patent
Weyrauch

(10) Patent No.: US 11,530,081 B2
(45) **Date of Patent: *Dec. 20, 2022**

(54) PLASTIC LINER WITH INNER LINING

(71) Applicant: MAUSER-WERKE GMBH, Bruehl (DE)

(72) Inventor: Detlev Weyrauch, Kreuzau-Untermaubach (DE)

(73) Assignee: MAUSER-WERKE GMBH, Bruehl (DE)

( * ) Notice: Subject to any disclaimer, the term of this patent is extended or adjusted under 35 U.S.C. 154(b) by 256 days.

This patent is subject to a terminal disclaimer.

(21) Appl. No.: 16/086,051

(22) PCT Filed: Mar. 23, 2017

(86) PCT No.: PCT/EP2017/000360

§ 371 (c)(1),
(2) Date: Sep. 18, 2018

(87) PCT Pub. No.: WO2017/162335

PCT Pub. Date: Sep. 28, 2017

(65) Prior Publication Data

US 2020/0290789 A1 Sep. 17, 2020

(30) Foreign Application Priority Data

Mar. 24, 2016 (DE) ..... 10 2016 003 496.3

(51) Int. Cl.
*B65D 77/04* (2006.01)
*B65D 6/00* (2006.01)
*B65D 25/42* (2006.01)

(52) U.S. Cl.
CPC ..... *B65D 77/0466* (2013.01); *B65D 11/10* (2013.01); *B65D 11/20* (2013.01); *B65D 25/42* (2013.01)

(58) Field of Classification Search
CPC .... B65D 77/0466; B65D 25/42; B65D 11/10; B65D 11/20; B65D 90/046; B65D 90/04;
(Continued)

(56) References Cited

U.S. PATENT DOCUMENTS 4,011,968 A * 3/1977 McGhie ..... B65D 35/12 222/107
5,375,741 A * 12/1994 Harris ..... B65D 11/10 222/105

(Continued)

FOREIGN PATENT DOCUMENTS

DE 202014007695 U1 11/2014
EP 0415719 A1 3/1991

(Continued)

OTHER PUBLICATIONS

International Search Report for International Application No. PCT/EP2017/000360, dated Jun. 13, 2017.

*Primary Examiner* — Stephen J Castellano
(74) *Attorney, Agent, or Firm* — Marshall, Gerstein & Borun LLP

(57) ABSTRACT

The present invention relates to a rigid plastics-material internal container (12) from a thermoplastic plastics material for a pallet container (10) or a similar large-volume retainer for storing and for transporting liquid or free-flowing filling materials, having a flexible inliner (28) from a thin-walled plastics-material or composite-material film that is inserted into the rigid plastics-material internal container (12).
For filling and removal at the base, the thin-walled inliner (28) at the base side has at least one filling and removal connector (42), said filling and removal connector (42) at the front being fixedly welded into a corresponding filling and removal connector (32) at the base side of the rigid plastics-material internal container (12). For filling from above and removal of the filling material at the base side, the rigid plastics-material internal container (12) and the thin-walled inliner (28) can in each case also be provided with an upper filling connector, wherein in this instance the upper filling connector (44) of the thin-walled inliner (28) is likewise
(Continued)

fixedly welded into the filling connector (30) of the rigid plastics-material internal container (12).

The thin-walled inliner (28) that is inserted in the rigid plastics-material internal container (12) in the assembled final state by way of vacuuming bears in a fully planar manner on the internal surface of the rigid plastics-material internal container (12), and in the empty non-filled state as well as in the filled state of the rigid plastics-material internal container (12) adheres in an immovable fixed manner, as if adhesively bonded, on the internal surface, in particular also on the upper base of the internal container.

13 Claims, 3 Drawing Sheets

(58) Field of Classification Search
CPC .. B65D 77/061; B65D 77/0453; B65D 77/06; B65D 77/068; B65D 2577/041
USPC ..... 220/23.91
See application file for complete search history.

(56) References Cited

U.S. PATENT DOCUMENTS

| | | | | |
|---|---|---|---|---|
| 5,680,955 | A * | 10/1997 | Schutz | B65D 77/0466 220/1.5 |
| 10,994,911 | B2 * | 5/2021 | Weyrauch | B65D 77/061 |
| 2002/0112980 | A1 * | 8/2002 | Przytulla | B65D 77/0466 206/386 |
| 2016/0001951 | A1 * | 1/2016 | Siebel | B65D 85/70 206/386 |

FOREIGN PATENT DOCUMENTS

| | | | |
|---|---|---|---|
| EP | 2090528 | A1 | 8/2009 |
| WO | WO-2011002925 | A2 | 1/2011 |

* cited by examiner

PLASTIC LINER WITH INNER LINING

CROSS-REFERENCE TO RELATED APPLICATION

This is the United States national phase of International Patent Application No. PCT/EP2017/000360, filed Mar. 23, 2017, which claims priority to German Application No. 10 2016 003 496.3, filed Mar. 24, 2016, the entire contents of each of which are hereby incorporated by reference.

FIELD OF THE DISCLOSURE

The invention relates to a thin-walled rigid plastics-material internal container having an inliner for a pallet container or a similar large-volume retainer for storing and for transporting liquid or free-flowing filling materials, comprising two longer side walls, a shorter rear wall, a shorter front wall, an upper base having a closable filling connector and a container base, wherein on the base side, in the center of the front wall, a lower removal region having a protective-housing-shaped molding, directed inward toward the inside of the plastics-material internal container is provided for disposing a closable removal fitting in a protected recessed manner, and wherein a flexible inliner from a thin-walled plastics-material or composite-material film, the former at the top being connected to the filling connector or/and at the bottom being connected to the removal connector having a removal fitting of the rigid plastics-material container, is inserted into the rigid plastics-material internal container.

BACKGROUND

Pallet containers (the usual trade name being "Intermediate Bulk Containers", hereunder also referred to as "IBC" or "IBCs") are extensively used for storing and for transporting, in particular hazardous, liquid or free-flowing filling materials, above all in the chemical industry. In the latter, IBCs are predominantly used for transporting liquid chemicals. The majority of these chemical products are classified as hazardous liquid filling materials because they pose a risk to the health of humans and animals and to the environment in a concentrated form. During storage and transportation in IBCs, the chemicals may stress, such as discolour, contaminate, embrittle, or damage, the HDPE material of the plastics-material internal containers in such a manner that the used internal containers cannot simply be washed and reused. In the case of a usual multiple use of used IBCs, the only remaining option is the replacement of the damaged plastics-material internal container with a new internal container. Considering that a plastics-material internal container, depending on the list of requirements, may weigh approx. 14 kg to 18 kg, this however represents a costly solution involving a not insignificant waste of plastics material. A more cost-effective solution lies in protecting the plastics-material internal container by means of an inserted thin inliner, or film bag, respectively, against contamination by the respective filling material, and on account thereof enabling multiple reuse or repeated use, respectively, of the internal container. In this instance, only the contaminated inliner needs to be disposed of, said inliner for a 1000 liter IBC, depending on the film thickness, merely having a weight of approx. 0.7 to 1.3 kg in terms of the plastics-material mass thereof, and a new inliner has to be inserted in order for the IBC to be reused.

Inserting thin-walled film bags, or inliners, respectively, into rigid box-shaped external containers, such as large rigid cardboard boxes or cardboard sleeves (bag in box) is a measure that has been usual for years. However, only cylindrical, cuboid, or cushion-shaped inliners of "simple construction" have always been available for square-shaped or rectangular-shaped external containers. Said inliners may be used without problems for containers that have an externally located removal system. Said simple inliners are not easily usable for IBCs having blow-molded stiff or rigid plastics-material internal containers, respectively, or for similar large-volume (that is to say with a capacity of typically approx. 500 l and more, commonly up to 1250 l for IBC containers) containers with inner containers having a protective housing that is molded inwardly into the internal container for a recessed removal fitting that is protected from external influences, because during handling in the case of installation, filling, removal, and removal from the rigid internal container they consistently lead to problems, there in particular inevitably being a formation of creases in the region about the lower removal connector.

The use of a thin film-type inliner in a rigid plastics-material internal container having a molded protective housing therein for the removal fitting of a usual pallet container is known from publication EP 2 090 528 A1. The focus herein is inter alia on securely fixing the thin-walled inliner removal connector in the rigid removal connector of the plastics-material internal container with the aid of the screwed-on removal fitting. In this case, the front periphery of the thin tubular film, using a sealing flange and a sealing lip, is jammed at the end side by an annular shoulder in the housing screw nut of the removal fitting on the threaded sleeve (having an external thread) that is welded to the bottle removal fitting. However, when the housing screw nut is placed ready for screwing, the periphery of the thin tubular film that is folded over can no longer be tightly held and no longer be seen; said folded-over periphery may easily slide out of place herein or even be imparted creases. Small pimples on the film periphery and respective depressions in the end wall of the threaded sleeve are intended to counteract this. In any case, fixing and securing the inliner removal connector against rotation is performed only by clamping, once the thread of the housing screw nut has been completely tightened. It has to be ensured at the same time that the opening lever of the removal fitting is exactly in the vertical position.

In the case of another large container that is known from U.S. Pat. No. 655,657 B1, the undesirable formation of creases in the region of the protective housing of the removal fitting within the plastics-material internal container has been identified as disadvantageous, and the thin-walled removal connector of the inliner as a supposedly suitable countermeasure has not been positioned in the base side proximity of the inliner front wall but rather close to the front-side periphery of the lower base of the cuboid-shaped inliner. Upon insertion of the inliner into the rigid internal container of the IBC, the front-side periphery of the lower base is then folded up in a rectangular manner, and the thin-walled removal connector of the inliner is guided through the rigid removal connector of the internal container and fixed. On account thereof however, the inliner cannot bear on the front wall of the internal container in a fully planar manner, and free spaces or cavities, respectively, remain below the inliner, laterally next to the protective housing of the internal container. As the filling of the IBC is increased, the inliner is pressed by the liquid filling material onto the protective housing and, laterally thereto, onto the base of the rigid internal container. Herein, the inliner is here too inevitably withdrawn from the lateral corner regions of the rigid internal container, and the inevitable formation of creases of the thin-walled inliner arises here too, even if this arises rather toward either side and no longer directly in front of the outlet opening of the removal connector. The problem of the formation of creases is thus also not completely solved here either.

In the case of all known IBCs, the thin-walled inliners by way of the lower flexible removal connector thereof are fastened to the lower rigid removal connector and at the top by way of the flexible filling connector of the former to the upper rigid filling connector of the plastics-material internal container, otherwise being freely suspended from top to bottom. When filling the pallet container, irrespective of this being from the top or from below in the case of a so-called "base filling", the liquid filling material is most often filled into the inliner at still increased process temperatures under pressure, or by way of a sharp jet. Intense fluttering of the film material often arises herein. The inliner base is frequently withdrawn from the container corners, forming creases which later may block the base-side removal opening during a removal of filling material. Depending on the filling level, the inliner together with the liquid content thereof by virtue of the external transportation rocking motions acting thereon wobbles back and forth in the upper region or airspace of the plastics-material internal container such that tensile stresses that are constantly variable act on the upper filling connector of the inliner, and the film material can rip or the flange weld seam of the inliner connector of the upper inliner wall can tear open. In order to obviate this phenomenon, expensive stress-resistant film materials have to be used in the production of the inliner. Composite films having advanced barrier properties unfortunately have only a very poor resistance to stress, and cannot be employed in many applications.

GENERAL DESCRIPTION

The present invention is based on the object of specifying a plastics-material internal container having an integrated inliner for pallet containers (IBC) or other large-volume retainers for storing and for transporting in particular hazardous liquid or free-flowing filling materials, said plastics-material internal container no longer having the disadvantages of the prior art and in particular avoiding with high reliability a formation of creases of the inliner in the interior of the rigid internal container in assembly and in pressurized filling with liquid filling material and in emptying the filling material. The application or handling, respectively, of the containers having inliners in terms of the user (filler and emptier) of the large-volume liquid containers, on account of the particular constructive design of said containers, should not differ in any way from the handling of containers without inliners.

This object is achieved by the special features of patent claim 1. The features in the dependent claims hereunder describe further advantageous potential design embodiments of the plastics-material internal container according to the invention. The proposed technical teaching opens up improved safety in the handling of IBCs and other large-volume container systems having shape-adapted inliners for use in IBCs and other large-volume containers having a blow-molded plastics-material internal container having a protective housing, inwardly molded in the internal container, for disposing the removal fitting in a protected recessed manner within the external lattice cage or other retainer of the pallet container or other large-volume container system. It has been established that customers do not accept and refuse further use of thin-walled inliners in IBCs when leakages of the inliner and/or disruptions in the removal of filling material arise, for example by virtue of the formation of creases of the inliner on the base, that clog the removal connector of the rigid plastics-material internal container from the inside.

An asset protection of high-value and multi-use-capable plastics-material internal containers is furthermore enabled by the constructive measures of the present invention by way of a disruption-free use of cost-effective inliners or film bags, respectively, such that no more material is unnecessarily wasted in terms of valuable blow-molded plastics-material internal containers.

This is effected in constructive manner in that the cuboid-shaped flexible inliner in the lower removal region also has a wall recess, directed inward and adapted so as to correspond to the protective-housing-shaped molding of the rigid plastics-material container (hereunder also synonymously referred to as a "removal fitting protective housing"), having two lateral wall parts, an upper wall part, and a rearward wall part having a flexible removal connector molded thereon, and is configured so as to bear in an exact fit on the internal surface of the molding of the removal fitting protective housing that protrudes into the interior of the rigid plastics-material container. On account thereof, in the case of an inliner that has been inserted into the plastics-material internal container there are no cavities below or laterally next to the still empty inliner base, that during continuous filling of known IBCs with liquid filling material are always filled, inevitably leading to distortions of customary inliners and to the formation of creases of the latter.

In a constructive design embodiment of the invention it is expediently provided herein that the cuboid-shaped flexible inliner is welded together from three blank panels, and to this end comprises an upper horizontal lid part having a centric filling connector, a lower horizontal base part having a notch with a notch shape that corresponds with the base shape of the wall recess, and a vertically encircling side-wall blank panel having area portions for the two lateral wall parts, as well as the upper wall part, and the rearward wall part of the wall recess of the inliner.

In a production-technology related design embodiment of the invention it is provided that the three blank panels in each case are welded together by way of a weld seam that horizontally encircles the external edge of the upper lid part and the external edge of the lower base part, and for closing the side-wall blank panel are welded together by way of a weld seam that runs vertically from top to bottom in the center of the front wall and through the center of the wall recess.

In another preferred production-technology related design embodiment of the invention it is provided that the three blank panels in each case are welded together by way of a weld seam that horizontally encircles the external edge of the upper lid part and the external edge of the lower base part, and for closing the side-wall blank panel are welded together by way of a weld seam that runs vertically from top to bottom in the center of the rear wall, wherein a weld waste running vertically from top to bottom up to the wall recess, for removing excess film portion above the wall recess, is provided in the center of the front wall. In the production of inliners having a weld waste, the weld seam of the weld waste advantageously does not run through the upper and rearward wall part of the wall recess of the inliner. The position of the welded annular-disk-shaped flange periphery of the flexible inliner removal connector is then also free from a vertical weld seam running therethrough.

Surprisingly, in the inliner according to the invention, the length of the upper horizontal weld seam is configured so as to be shorter than the length of the lower horizontal weld seam, or the upper weld seam circumference of the upper lid part is configured so as to be shorter than the lower weld seam circumference of the lower base part, and the front-side vertical weld seam of the side-wall blank panel is configured so as to be longer than the height of the inliner cuboid. This is enabled by integrating the area portions for the two lateral wall parts and for the upper and the rearward wall part of the wall recess of the inliner into the vertically encircling side-wall blank panel. This indeed necessitates somewhat more cutting waste in terms of film material, and a curved weld seam in the upper and rearward wall part of the wall recess, but this does save complex welding of four individual small wall parts of the wall recess.

According to one particularly preferred process-technology related embodiment of the invention it is provided that the inliner after insertion and welding to the rigid filling connector and removal connector of the plastics-material internal container is inflated using compressed air, and excess air is removed without residue by vacuum pumps from the intermediate space between the external surface of the inliner and the internal surface of the plastics-material internal container until no air and no intermediate space remains between the inliner and the plastics-material internal container such that a stable vacuum is set, said vacuum, upon gas-tight closure of the container opening by way of which the excess air has been evacuated, being durably maintained during the entire intended use of the pallet container until the next replacement of the used inliner. An extraordinary handling friendliness of the pallet container according to the invention is achieved in that the flexible inliner by way of the upper filling connector thereof is welded in a materially integral manner to the upper filling connector of the rigid plastics-material internal container, and by way of the lower thin-walled removal connector thereof is welded in a materially integral manner to the lower removal connector of the rigid plastics-material internal container, in each case in a gas-tight and liquid-tight manner, while the entire external surface of the inserted inliner is operatively connected to the entire internal surface of the plastics-material internal container and is connected to the latter in a force-fitting manner. On account thereof it is precluded with utmost reliability that creases continue to be able to be formed in front of the lower removal connector in the inliner. The inliner sits like a second skin in the plastics-material internal container, so to speak. In order to enable vacuum pumping, an additional container opening may be disposed at any suitable location in the upper base. The container opening is preferably embodied as a 2-inch spout opening, which is closable in a gas-tight and liquid-tight manner by way of a 2-inch spout plug, preferably having an inbuilt one-way valve. A vacuum/compressed-air pump is connected to the container opening on demand.

BRIEF DESCRIPTION OF THE DRAWINGS

The invention will be explained and described in more detail hereunder by means of an exemplary embodiment that is schematically illustrated in the drawings, in which.

DETAILED DESCRIPTION

Figure 1:
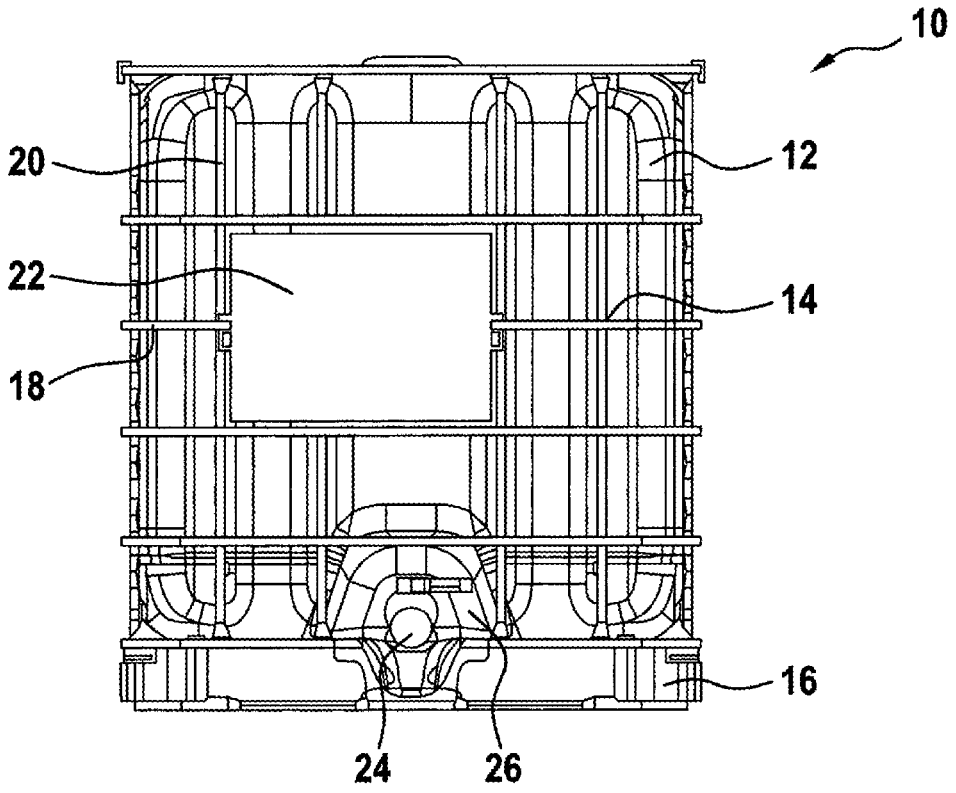
FIG. 1 shows a front view of a pallet container having a rigid plastics-material internal container according to the invention and a thin-walled inliner inserted into the latter.

A pallet container having a plastics-material internal container (12) according to the invention for storing and for transporting in particular hazardous liquid or free-flowing filling materials is identified by the reference sign 10 in FIG. 1. For employment, or for use, respectively, in the context of hazardous liquid filling materials, the pallet container 10 meets particular testing criteria, and is provided with a respective official classification by BAM (Bundesamt für Materialprüfung—Federal Institute for Materials Testing). In an embodiment for a filling material volume of approx. 1000 l, the pallet container 10 has standardized dimensions, having a length of approx. 1200 mm, a width of approx. 1000 mm, and a height of approx. 1150 mm. However, IBCs having other dimensions and having a smaller or larger filling volume of 800 l to 1300 l are also widely used.

The salient elements of the pallet container 10 shown are composed of a thin-walled rigid internal container 12 that is produced by the blow-molding method from a thermoplastic plastics material, of a tubular lattice frame 14 that as a supporting jacket tightly encloses the cuboid-shaped plastics-material internal container 12, and of a base pallet 16 on which the plastics-material internal container 12 bears and to which the tubular lattice frame 14 is fixedly connected. The external tubular lattice frame 14 is composed of welded-together horizontal and vertical tubular bars 18, 20. In order for a closed lattice cage to be obtained as an external container, the horizontal tubular bars 18 that run in an annular encircling manner each are fixedly interconnected at a connection point. The base pallet 16 in the illustrated version is configured as a composite pallet having an upper steel-sheet support plate, having a tubular steel support frame disposed therebelow, and having plastics-material corner and central feet. A labeling plate 22 from thin steel sheet, for identification of the respective liquid filling material, is fixed on the front side of the tubular lattice frame 14. A removal fitting 24 for retrieving the liquid filling material is connected in the center of the base of the plastics-material internal container 12.

In a manner corresponding to the dimensions of the pallet container 10, the cuboid-shaped plastics-material internal container 12 has two longer side walls, a shorter rear wall, a shorter front wall, an upper base having a closable filling connector 30, and a container base, wherein on the base side in the center of the front wall a lower removal region having a protective-housing-shaped molding 26, directed inward toward the inside of the plastics-material internal container 12, for disposing the closable removal fitting 24 in a protected and recessed manner is provided. In order for the rigid plastics-material internal container 12 to be protected against contamination by the filled filling material, and in order for multiple reuse of the valuable internal container to be enabled, a thin-walled likewise cuboid-shaped flexible inliner 28 (also referred to as a film bag) is inserted into the rigid plastics-material internal container 12 prior to each new filling of the pallet container 10, which inliner 28 is connected at the top to a filling connector 30 and at the bottom to a removal connector 32 of the rigid plastics-material internal container 12.

Figure 2:
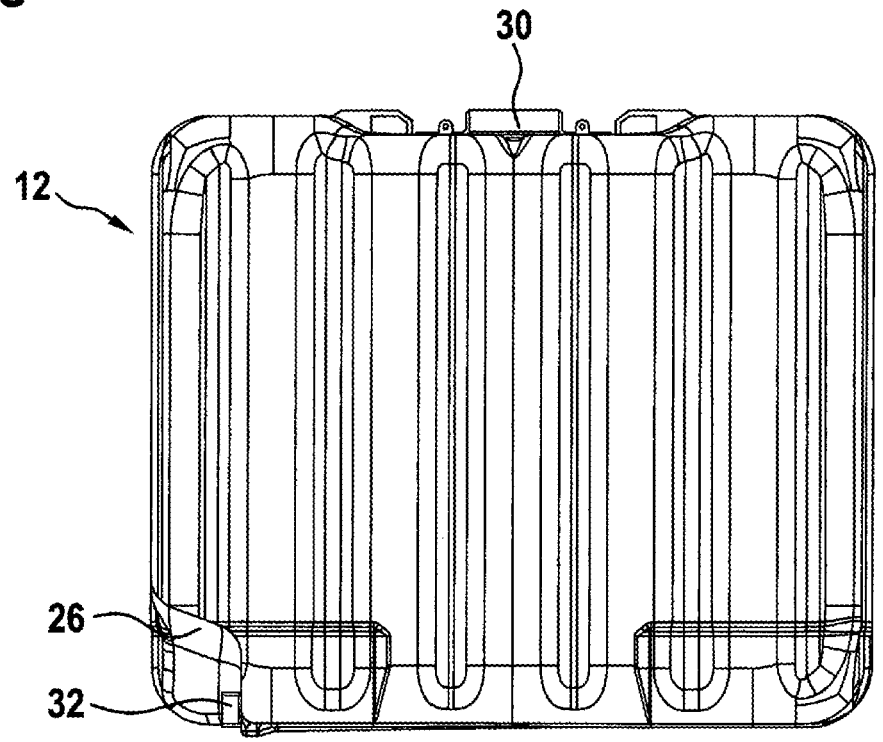
FIG. 2 shows a side view of a rigid plastics-material internal container.

This cuboid-shaped flexible inliner 28 is schematically illustrated per se, without the enclosing plastics-material internal container 12, in FIG. 2. As opposed to the rigid plastics-material internal container 12 which during handling thereof in any case remains dimensionally stable, the inliner 28 by virtue of the thin-wall construction thereof, is not dimensionally stable per se, but is very flexible, yielding, and adaptable. The wall thickness of the usually multi-layered inliner composite film is approx. 100-150 μm, having a mass-per-unit-area of approx. 100-150 g/m$^2$; this results in a material weight of approx. 0.7-1.3 kg for a 1000 l inliner bag. The inliners employed are typically produced from a multi-layered plastics-material composite film. Herein, the wafer-thin composite layers may be composed of various materials such as, for example, HDPE or LDPE/EVOH/PET/PA/bonding agents/SiOx, and/or be provided with a glass-fiber or woven-fabric reinforcement. Depending on the type of application, the composite film is equipped with barrier layers against the diffusion of hydrocarbons, oxygen, or water vapor, or with an aseptic antibacterial coating, or a vapor-deposited metal foil containing silver or aluminum. In any case, however, the welded inliner connectors, that is to say the removal connector 42 and the filling connector 44 are made from the same flexible multi-layered film material as the remaining film wall of the inliner 28.

According to the present invention, the cuboid-shaped flexible inliner 28 is distinguished in that the latter in the forward lower removal region has a wall recess 34, directed inward and adapted so as to correspond with the protective-housing-shaped molding 26 of the rigid plastics-material internal container 12. The wall recess 34 includes two lateral wall parts 36, an upper wall part 38, and a rearward wall part 40 having a flexible removal connector 42 molded thereon, and is configured so as to bear completely in an exact fit on the internal surface of the molding 26, and the internal surface protrudes into the interior of the rigid plastics-material internal container 12. For reasons of improved clarity, this wall recess 34 of the inliner 28 herein is illustrated as being very box-shaped. Of course, the walls and wall transitions may also be configured so as to be trough-shaped heavily rounded, flattened and/or mutually transitioning, but in any case so as to be adapted to the respective protective-housing-shaped molding 26 of the rigid plastics-material internal container 12.

Figure 3:
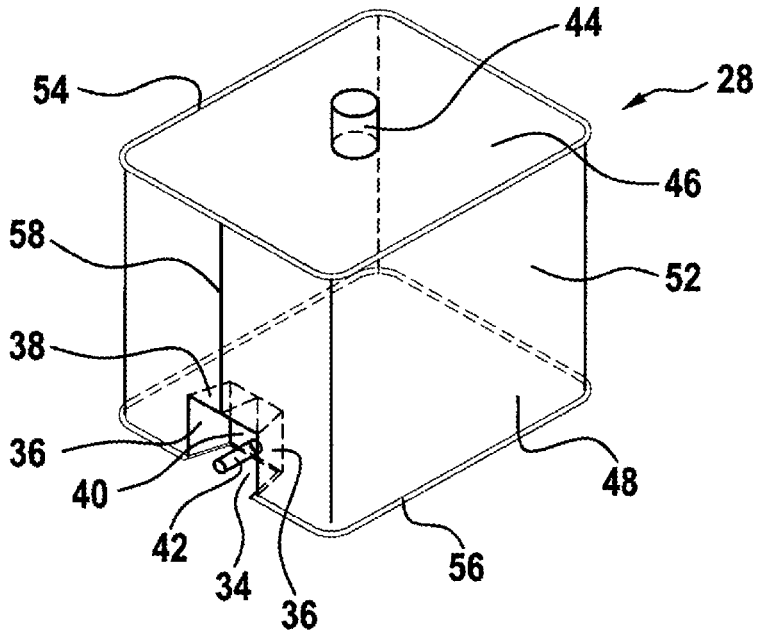
FIG. 3 shows a perspective view of an inserted inliner.

The flexible inliner 28 for a usual 1000 l pallet container has a cuboid-shaped design, having a length LI of approx. 1150-1190 mm, a width BI of approx. 950-990 mm, and a height HI of approx. 950-1050 mm. The length measurements should be exactly adhered to within a positive/negative tolerance (+/−) of 2 mm. In terms of production technology, the cuboid-shaped flexible inliner 28 is welded together from three blank panels. As can be seen in FIG. 3, these three blank panels are composed of an upper horizontal lid part 46, having the centric flexible filling connector 44, a lower horizontal base part 48, having a clearance 50 that corresponds to the base shape of the wall recess 34, and a vertically encircling side-wall blank panel 52, having area portions for the two lateral wall parts 36, and the upper wall part 38 and the rearward wall part 40 of the wall recess 34 of the inliner 28. The three blank panels are welded together by way of two weld seams 54, 56 that horizontally encircle the external edge of the upper lid part 46 and the external edge of the lower base part 48, and for closing the side-wall blank panel 52 are welded together by way of a weld seam 58 that runs vertically from top to bottom in the center of the front wall and through the center of the wall recess 34. After completion of the inliner 28 from the three blank panels, the length of the upper horizontal weld seam 54, that is to say the upper weld seam circumference, is approx. 4100-4150 mm, the length of the lower horizontal weld seam 56, that is to say the lower weld seam circumference, is approx. 4265-4310 mm, and the front-side vertical weld seam 58 is approx. 1050-1100 mm for an inliner for a filling material volume of approx. 1000 l.

Of course, the inliner 28 can also be welded together from a plurality of blank panels in another way.

Prior to the inliner 28 being inserted into the rigid plastics-material internal container 12, the upper filling connector 44 of the flexible inliner should have a diameter of approx. 145 mm or 225 mm, and a length of approx. 300 mm, and the lower flexible removal connector 44 should have a diameter of approx. 2", 3", or 150 mm, and a length of at least 100 mm. After insertion of the inliner 28 into the rigid plastics-material internal container 12, the filling connector 44 and the removal connector 42 of the flexible inliner 28 each are folded over the filling connector 30 and the removal connector 32 of the rigid plastics-material internal container 12, push-fitted there over, welded thereto in a tensile-force- and tension-force-free manner in the interior of the rigid filling connector 30 and the removal connector 32, and then cut to the appropriate length.

Figure 4:
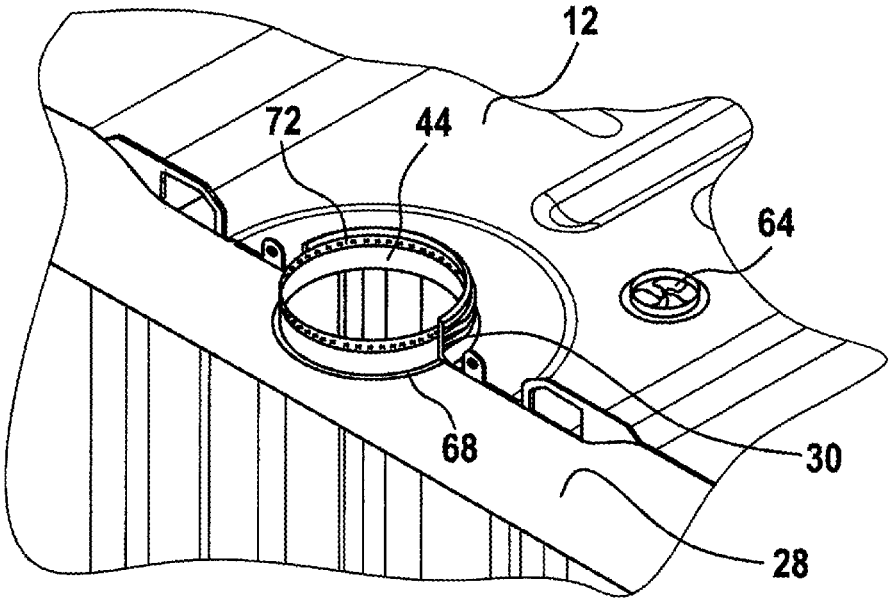
FIG. 4 shows a perspective view of a partial section about the region of the upper filling opening of the plastics-material internal container.

The upper filling region of the rigid plastics-material internal container 12 having the filling connector 30 molded thereon and the filling connector 44 of the flexible inliner 28 welded thereto can be seen in an illustration of a partial section in FIG. 4. The flexible filling connector 44 pulled taught in an upward manner on the exterior by way of a narrow flange periphery 68 on the upper side of the inliner 28, on the one hand, is aligned to the correct position according to a "circle" mark (not visible), then pulled over the rigid filling connector 30, and by way of a comparatively large annular weld seam 72 welded in a gas-tight and liquid-tight manner so as to be fixed and secured against rotation on the internal side just below the end side of the rigid filling connector 30, whereupon the superfluous hose piece of the flexible inliner filling connector 44 is cut off so as to be flush. In order to be able to let excess air escape from the intermediate space between the inliner 28 and the plastics-material internal container 12 when the inliner 28 is being inflated, and/or to enable vacuum pumping from this intermediate space, an additional container opening 64 is provided at any suitable location in the upper base of the rigid plastics-material internal container 12. The container opening 64 is preferably embodied as a 2-inch spout opening which is closable in a gas-tight and liquid-tight manner by way of a 2-inch spout plug that preferably has an inbuilt one-way valve. A vacuum/compressed-air pump is connected to the container opening 64 on demand.

Figure 5:
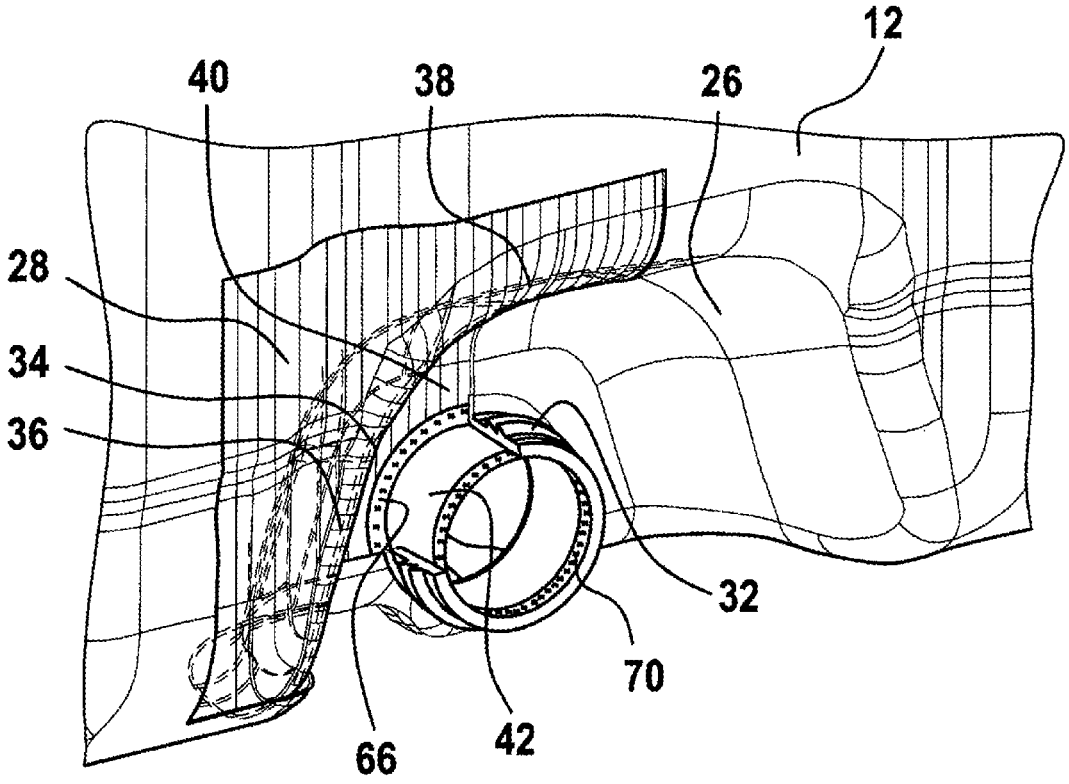
FIG. 5 shows a perspective view of a partial section about the region of the lower removal opening of the plastics-material internal container.

Finally, the lower removal region of the plastics-material internal container 12 having the rigid removal connector 32 molded thereon and the removal connector 42 of the flexible inliner 28 that is radially welded therein can be seen in an illustration of a partial section in FIG. 5.

For improved understanding, a rectangle has been cut out of the wall of the rigid plastics-material internal container herein, wherein the section line runs through the removal connector 32, through the molded protective housing 26, and through a small piece of the front wall of the plastics-material internal container 12 such that the inliner 28 bearing thereon, having a curved wall recess 34, identified by a multiplicity of vertical lines, can be seen in the cut-out rectangle. The hidden left-hand rear part of the wall recess 34 is furthermore also indicated by dashed lines.

It can be clearly seen in the rectangular cut-out that the flexible removal connector 42 on the inside or on the rear side, respectively, by way of a narrow welded annular flange 66 is welded onto the rearward wall part 40 of the wall recess 34 of the inliner 28, and on the external side by way of a smaller radial annular weld seam 70 is welded into the rigid removal connector 32, in each case in a gas-tight and liquid-tight manner. It is important herein that the inliner 28 by way of the shape-adapted wall recess 34 thereof bears on the internal surface of the molding 26 of the rigid internal container 12 in a fully planar manner, like a second skin, as can be seen in FIG. 5, such that no intermediate spaces or cavities, respectively, whatsoever may remain therebetween, as has been the case to date with known IBCs having usual inliners.

A substantial advantage of the second-skin inliner lies in that the film bag does not require any high tensile strength in relation to fluttering during filling or to-and-fro swashing of the liquid filling material during transportation movements, since no movement whatsoever of the inliner film material is performed herein, because the latter is vaccumed fixedly and durably on the internal side of the plastics-material internal container 12, as if adhesively bonded, so to speak. On account thereof, inexpensive rupture-sensitive film materials having advanced barrier properties may also be used now.

The upper flexible filling connector 44 and the lower flexible removal connector 42 of the flexible inliner 28 are expediently produced from the same film material, having the same barrier properties, as the film material of the flexible inliner 28. Known inliners are often provided with filling connectors and removal connectors, having an integrally molded flange periphery for welding to the multi-layered composite film material of the inliner, that are prefabricated from thermoplastic plastics-material such as LDPE by the injection-molding method. These filling connectors and removal connectors are in most instances also configured so as to be somewhat thicker and more rigid. However, said connectors per se do not have any barrier properties. Inliners of this type, having filling connectors/removal connectors that are produced by the injection-molding method, are not suitable for oxygen-sensitive liquids, such as fragrances for the production of perfume, for example, or additives for the production of foodstuffs. By contrast, in the case of the inliner 28 according to the invention, the filling connectors/removal connectors (42, 44) are equipped with the same barrier properties as the inliner 28 per se, and disadvantageous diffusion procedures that penetrate the plastics material are precluded.

The protective-housing-shaped molding 26 that is directed inward into the plastics-material internal container 12 for disposing the closable removal fitting 24 in a protected recessed manner does not have to be embodied in a strict box-shaped manner such as is illustrated as an exemplary embodiment in the drawings, but can of course also be shaped so as to be trough-shaped, having soft rounded housing side walls. The shape-adapted molding in the thin-walled inliner is in this instance configured in a corresponding manner.

The rigid plastics-material internal container having the inserted inliner can also be used in any other large-volume enclosing external container having a pallet-type substructure instead of in a pallet container having an external supporting tubular lattice frame and a base pallet. Said alternative could be a stable all-plastics-material container or a stiff cardboard box having a wooden pallet, for example.

When a plastics-material internal container according to the invention, having an inliner that is shape-adapted to the internal surface of the plastics-material internal container is used, in order for a pallet container or a similar large-volume container system to be reconditioned after use, only the contaminated inliner has to be disposed of, said inliner, depending on the film thickness, for a 1000 liter IBC having a weight of only approx. 0.7 to 1.3 kg in terms of the plastics-material mass excluding the filling-material contaminations, and a new shape-adapted inliner has to be inserted in order for the container to be reused. In the case of a replacement of the rigid internal container, in the case of an IBC having a weight of approx. 14 kg, comparatively high production costs would arise only on account of the material costs, while the replacement of an inliner causes significantly lower costs of only approx. 10%. The present invention by virtue of the lower material consumption offers a cost-effective and environmentally friendly solution for the reuse of used pallet containers and of similar large-volume containers.

The invention claimed is:

1. A thin-walled plastics-material rigid internal container for a pallet container or a similar large-volume retainer for storing and for transporting liquid or free-flowing filling materials, the internal container comprising: two longer side walls, a shorter rear wall, a shorter front wall, an upper area having a closable filling connector, and a container base, the container base including a lower removal region having a protective-housing-shaped molding, which is directed inward toward an inside of the internal container, and is provided for disposing a closable removal fitting in a protected recessed manner, and a cuboid-shaped flexible inliner is formed from a thin-walled plastics-material or composite-material film and inserted into the internal container, the flexible inliner having a top portion being connected to the closable filling connector or/and a bottom portion being connected to the closable removal fitting of the internal container, wherein the flexible inliner has a wall recess adjacent to the lower removal region of the internal container, the wall recess directed inward and adapted to correspond with the protective-housing-shaped molding of the internal container, and the wall recess of the flexible inliner having two lateral wall parts, an upper wall part, and a rearward wall part having a flexible removal connector molded thereon, wherein the wall recess is configured so as to bear completely in an exact fit on an internal surface of the protective-housing-shaped molding, and the internal surface protrudes into the inside of the internal container, and wherein the flexible inliner comprises a lower horizontal base part having a notch with a notch shape that corresponds with a base shape of the wall recess.

2. The plastics-material internal container as claimed in claim 1, characterized in that the cuboid-shaped flexible inliner is welded together from three blank panels, and comprises an upper horizontal lid part having a centric flexible filling connector, and a vertically encircling side-wall blank panel having area portions for the two lateral wall parts, the upper wall part, and the rearward wall part of the wall recess of the inliner.

3. The plastics-material internal container as claimed in claim 2, characterized in that the three blank panels in each case are welded together by way of an upper and a lower weld seam that horizontally encircle an external edge of the upper lid part and an external edge of the lower base part, and for closing the side-wall blank panel are welded together by way of a weld seam that runs vertically from top to bottom in the center of the front wall and through a center of the wall recess.

4. The plastics-material internal container as claimed in claim 2, characterized in that the three blank panels in each case are welded together by way of an upper and a lower weld seam that horizontally encircle an external edge of the upper lid part and an external edge of the lower base part, and for closing the side-wall blank panel are welded together by way of a weld seam that runs vertically from top to bottom in a center of the rear wall, wherein a weld waste running vertically from top to bottom up to the wall recess is provided in the center of the front wall.

5. The plastics-material internal container as claimed in claim 4, characterized in that the length of the upper weld seam is shorter than the length of the lower weld seam, or a circumference of the upper weld seam of the upper lid part is shorter than a circumference of the lower weld seam of the lower base part, and the vertical weld seam of the side-wall blank panel is longer than a height of the inliner.

6. The plastics-material internal container as claimed in claim 5, characterized in that in the case of an inliner having a 1000 l filling material volume, the length of the upper weld seam, that is to say the circumference of the upper weld seam (SNUo), is 4100 mm-4150 mm, the length of the lower weld seam, that is to say the circumference of the lower weld seam (SNUu), is approx. 4265-4310 mm, and the vertical weld seam is approx. 1050-1100 mm long.

7. The plastics-material internal container as claimed in claim 1, characterized in that the flexible inliner for a filling material volume of approx. 1000 l has a cuboid shape having a length (LI) of 1150-1190 mm, a width (BI) of 950-1050 mm, and a height (HI) of 950-1050 mm, and the wall of said inliner is welded together from three blank panels.

8. The plastics-material internal container as claimed in claim 1, characterized in that the flexible inliner has an upper filling connector having a diameter of approx. 145 mm or approx. 225 mm, and a length of 290 to 310 mm, and a lower flexible removal connector having a diameter of approx. 2" or 3", and a length of at least 100 mm.

9. The plastics-material internal container as claimed in claim 8, characterized in that the flexible inliner by way of the upper filling connector thereof is welded in a materially integral manner into the filling connector of the rigid plastics-material internal container, and by way of the lower flexible removal connector thereof is welded in a materially integral manner into the removal connector of the rigid plastics-material internal container, in each case in a gas-tight and liquid-tight manner, while an entire external surface of the inliner is operatively connected to an entire internal surface of the plastics-material internal container and is connected to the latter in a force-fitting manner.

10. The plastics-material internal container as claimed in claim 8, characterized in that the upper flexible filling connector and the lower flexible removal connector of the flexible inliner are produced as a tubular film from the same multi-layered composite film material having the same barrier properties as the multi-layered composite film material of the flexible inliner.

11. A method for inserting a new inliner into a plastics-material internal container as claimed in claim 1, characterized in that the inliner after insertion and welding to the filling connector and removal connector of the plastics-material internal container is inflated using compressed air, and excess air is removed without residue by vacuum pumps from an intermediate space between an external surface of the inliner and an internal surface of the plastics-material internal container until no air and no intermediate space remains between the inliner and the plastics-material internal container such that a stable vacuum is set, said vacuum, upon gas-tight closure of the container opening by way of which the excess air has been evacuated, being durably maintained during an entire intended use of the container until the next replacement of the used inliner.

12. A thin-walled plastics-material rigid internal container for a pallet container or a similar large-volume retainer for storing and for transporting liquid or free-flowing filling materials, the internal container comprising: two longer side walls, a shorter rear wall, a shorter front wall, an upper area having a closable filling connector, and a container base, the container base including a lower removal region having a protective-housing-shaped molding, which is directed inward toward an inside of the internal container, and is provided for disposing a closable removal fitting in a protected recessed manner, and a cuboid-shaped flexible inliner is formed from a thin-walled plastics-material or composite-material film and inserted into the internal container, the flexible inliner having a top portion being connected to the closable filling connector or/and a bottom portion being connected to the closable removal fitting of the internal container, wherein the flexible inliner has a wall recess adjacent to the lower removal region of the internal container, the wall recess directed inward and adapted to correspond with the protective-housing-shaped molding of the internal container, and the wall recess of the flexible inliner having two lateral wall parts, an upper wall part, and a rearward wall part having a flexible removal connector molded thereon, wherein the wall recess is configured so as to bear completely in an exact fit on an internal surface of the protective-housing-shaped molding, and the internal surface protrudes into the inside of the internal container, wherein the flexible inliner comprises a lower horizontal base part having a notch with a notch shape that corresponds with a base shape of the wall recess, and a further container opening which is closable in a gas-tight and liquid-tight manner is provided in the upper area of the plastics-material internal container.

13. The plastics-material internal container as claimed in claim 12, characterized in that the further container opening is configured as a 2-inch spout opening, which is closable in a gas-tight and liquid-tight manner, and is provided for connecting to a compressed-air/vacuum pump.

* * * * *